US007290318B2

(12) United States Patent
Bradley et al.

(10) Patent No.: US 7,290,318 B2
(45) Date of Patent: Nov. 6, 2007

(54) ELECTROMAGNETIC FLANGING AND HEMMING APPARATUS AND METHOD

(75) Inventors: John R. Bradley, Clarkston, MI (US); John E. Carsley, Clinton Township, MI (US)

(73) Assignee: General Motors Corporation, Detroit, MI (US)

( * ) Notice: Subject to any disclaimer, the term of this patent is extended or adjusted under 35 U.S.C. 154(b) by 129 days.

(21) Appl. No.: 10/929,207

(22) Filed: Aug. 30, 2004

(65) Prior Publication Data

US 2005/0229377 A1 Oct. 20, 2005

Related U.S. Application Data

(60) Provisional application No. 60/562,853, filed on Apr. 15, 2004.

(51) Int. Cl.
*B23P 17/00* (2006.01)

(52) U.S. Cl. ..... 29/419.2; 29/505

(58) Field of Classification Search ..... 29/509, 29/419.2, 243.5; 72/56
See application file for complete search history.

(56) References Cited

U.S. PATENT DOCUMENTS

| | | | | |
|---|---|---|---|---|
| 4,602,139 | A * | 7/1986 | Hutton et al. | 219/603 |
| 6,138,355 | A * | 10/2000 | Grassi | 29/894.323 |
| 6,365,883 | B1 * | 4/2002 | Pohl | 219/634 |
| 6,523,244 | B1 * | 2/2003 | Bissonnette | 29/509 |
| 6,523,277 | B1 * | 2/2003 | Bissonnette | 29/509 |
| 6,927,370 | B2 * | 8/2005 | McClure et al. | 219/603 |
| 6,968,718 | B2 * | 11/2005 | Imamura | 72/56 |

* cited by examiner

*Primary Examiner*—David P. Bryant
*Assistant Examiner*—Christopher M Koehler

(57) ABSTRACT

Apparatus and methods are disclosed for applying electromagnetic force (EMF) to flanging and hemming metal panels to form a hemmed panel assembly. First and second apparatus and method steps use a translating EMF coil to flange a sheet and to finish a hem by progressive non-planar bending. An alternate embodiment uses EMF hemming for difficult-to-hem portions of a flange and optionally precedes this with conventional hemming of straight hem portions.

7 Claims, 8 Drawing Sheets

ELECTROMAGNETIC FLANGING AND HEMMING APPARATUS AND METHOD

CROSS REFERENCE TO RELATED APPLICATIONS

This application claims priority from U.S. Provisional Patent Application No. 60/562,853 filed Apr. 15, 2004.

TECHNICAL FIELD

This invention relates to hemming the edges of inner and outer body panels to form a hemmed assembly having closed edges and to flanging of outer panels prior to hemming. More particularly, the invention relates to electromagnetic (EMF) flanging and hemming apparatus and methods.

BACKGROUND OF THE INVENTION

Electromagnetic (EMF) forming uses very high-current pulses in a specially designed electrical coil to generate magnetic fields, which impart opposing magnetic fields in a highly electrically conductive metal workpiece, such as an aluminum alloy or steel. With the coil held in a fixed position, the repulsive magnetic forces act upon the workpiece causing it to deform at very high strain rates. Metals deformed at these very high strain rates can exhibit "hyperplasticity," a level of plastic ductility well beyond what the material is capable of during conventional forming, e.g. flanging and hemming, operations.

Roller hemming uses a solid wheel, driven and controlled by a robot (or other device) to gradually bend a 90° flange to a closed hem position as it traverses the perimeter of a panel. The roller hem usually requires two to three passes around the panel to completely bend the flange to the closed, flat hem position.

An advantage of the roller hem method compared to conventional hemming is the alternate strain path through which the flange is bent. Conventional hemmers deform the flange through a "plane strain bending" path, which is very severe and can cause cracking failure when hemming aluminum panels, especially panels stamped from AA6111. The roller hem method imparts a component of strain in the direction of the hem line, different from "plane strain bending," that allows AA6111 to be flat hemmed without cracking.

SUMMARY OF THE INVENTION

This invention combines concepts from the technologies of electromagnetic force (EMF) forming and roller hemming to provide a method for flanging and hemming sheet metal panels.

In this invention, the solid roller of the roller hemming concept is replaced with an electromagnetic coil designed to force the sheet metal flange to bend around the hemline to the closed hem position. A robot, or other device, can drive the electromagnetic coil with translation and rotation around the part contour as required. The combined advantages of non-plane strain bending and hyperplasticity may be realized to avoid cracking failure in aluminum panels.

In an alternative embodiment, electromagnetic forces may be used to flange and/or hem a curved or otherwise shaped "difficult to hem" portion of a longer hem wherein the other portions of the hem could be flanged or hemmed by conventional hemming apparatus and methods. The electromagnetic forces could be applied by a stationary coil fitted in a conventional hemming machine and performing plane strain bending assisted by hyperplasticity of the formed material, or the forces could be applied by a traveling coil as previously mentioned to include the advantages of non-plain strain bending.

In another alternative embodiment, the very large electromagnetic forces would be managed by employing a rigid stationary electromagnetic hemming anvil, in which the forming coils would remain stationary, and the sheet metal components would be moved progressively through them, with rapidly repeating electromagnetic pulses forming the complete hem.

Benefits to be realized from the invention include:

Flexible Manufacturing—non-product specific tooling can be created to flat hem many different products.

Preservation of class—A surface quality—the electromagnetic forming process requires no direct contact with the workpiece.

Non-plane strain bending—the alternate strain path enables greater bending plasticity to avoid cracking in AA6111 aluminum panels.

Improved hem quality—electromagnetic (EMF) forming enhances the ductility of metals, which can enable greater bending strains and sharper hems to attain the "jewel" effect at the hemline.

Elimination of the conventional flanging process—EMF may be used to flange and hem panels from 180° open to the closed, flat hem condition. The hold-down fixture of the inner panel could be used to provide the support needed to establish the break line of the hem. Alternatively, the outer edge of the inner panel could also be used to wrap the outer flange around the inner panel, creating a tight, flat, crisp hem appearance.

The robotic end effector or stationary anvil-type flanging/hemming base could include two or more EMF coils in series to flange and hem the outer panel in a single pass. Multiple coils would each bend the flange a controlled amount.

These and other features and advantages of the invention will be more fully understood from the following description of certain specific embodiments of the invention taken together with the accompanying drawings.

DESCRIPTION OF EXEMPLARY EMBODIMENTS

Figure 1:
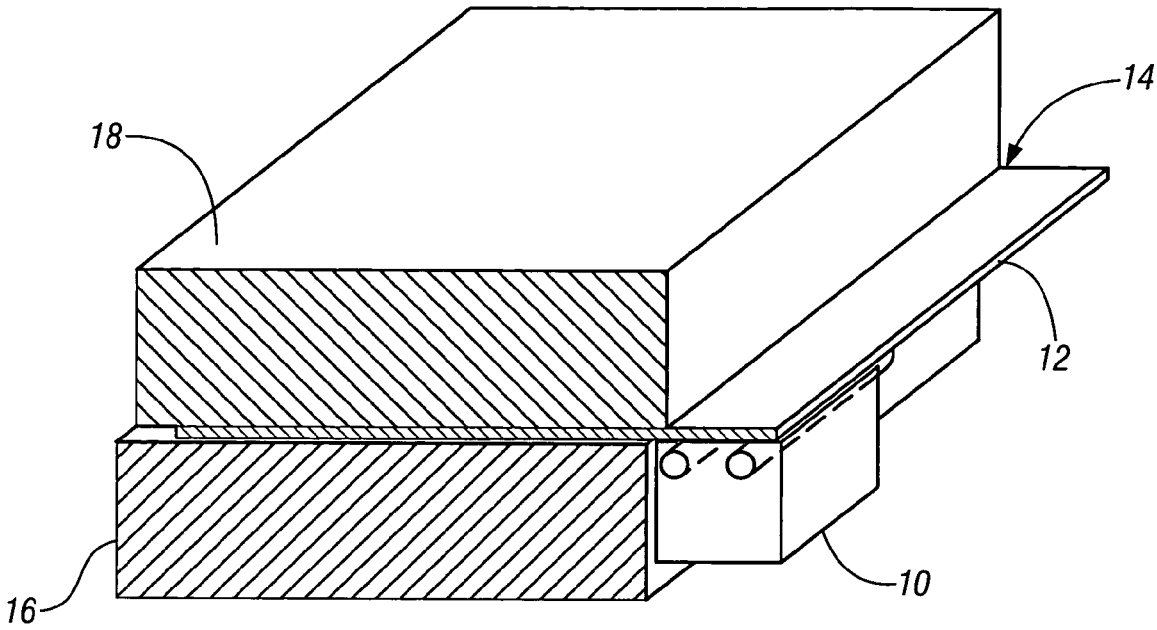
FIGS. 1-5 are simplified isometric cross-sectional views of an electromagnetic force (EMF) flanging apparatus illustrating steps in the EMF flanging of a panel sheet in preparation for hemming.

Manufacture of hemmed panel assemblies commonly involves a series of manufacturing steps, including forming, flanging and hemming. The hemming process begins with individual metal sheets that are cut, surface treated as desired and formed by known processes, such as by drawing or stamping, into three dimensional panels ready to be assembled into a panel assembly. These steps do not form part of the apparatus and method of the present invention, although they may be combined with this invention to form a hemmed panel manufacturing process.

This invention is directed to apparatus and methods used in flanging and/or hemming steps involving electromagnetic forming of hemmed panel assemblies. The following exemplary embodiments and steps incorporate various related concepts of flexible EMF flanging and hemming, as shown in the drawings.

Outer Panel Flanging

An initial step directed to electromagnetic (EMF) flanging of an outer panel for hemming is illustrated in FIG. 1. The figure shows the initial setup wherein an electromagnetic coil 10 is positioned close to a sheet metal flange 12 extending from an outer panel 14 made from steel or aluminum alloy, as an example. The flange 12 is to be bent from a 180° open position to a flanged position of 90° open.

The outer panel 14 is supported by suitable tooling, such as anvil 16, and is retained by hold-down tooling 18, which provides a rigid support against which the flange will be bent and which establishes the flange radius. The EMF coil 10 is part of end-of-arm-tooling supported and driven by a robot or other device (not shown).

Electromagnetic forces are used in this invention to deform the sheet to produce a flange along the periphery of a formed outer closure panel, and, in a subsequent step, to further deform the flange to join inner and outer panels with a hem. A very high current pulse from a capacitor bank, not shown, is passed through the coil 10 held in proximity to the workpiece. The current pulse results in a high magnetic field around the coil.

Figure 2:
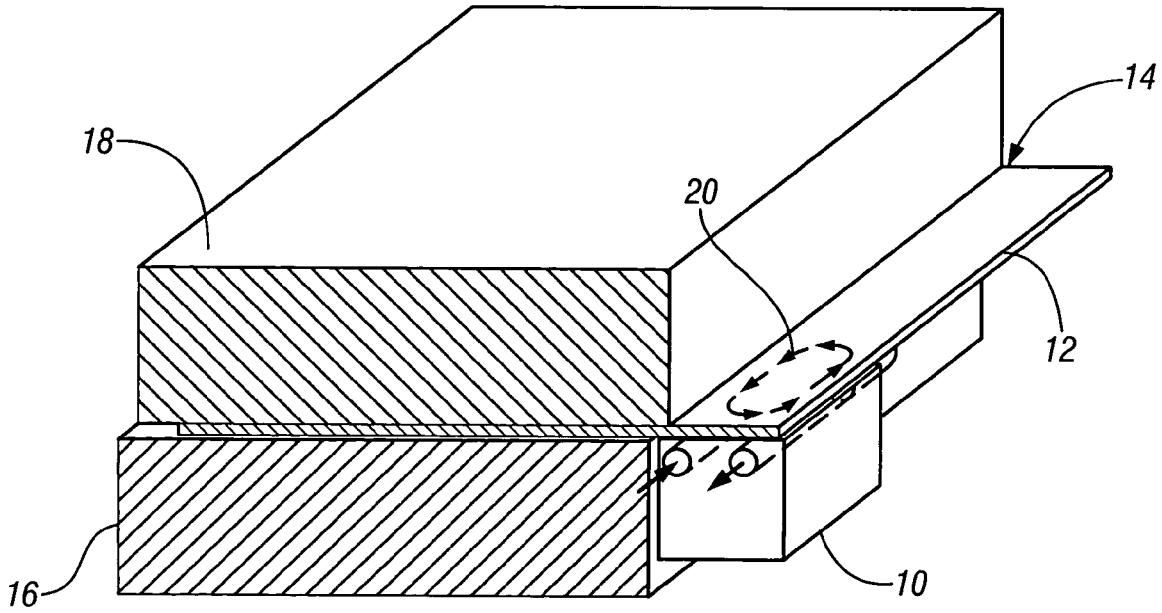
Figure 3:
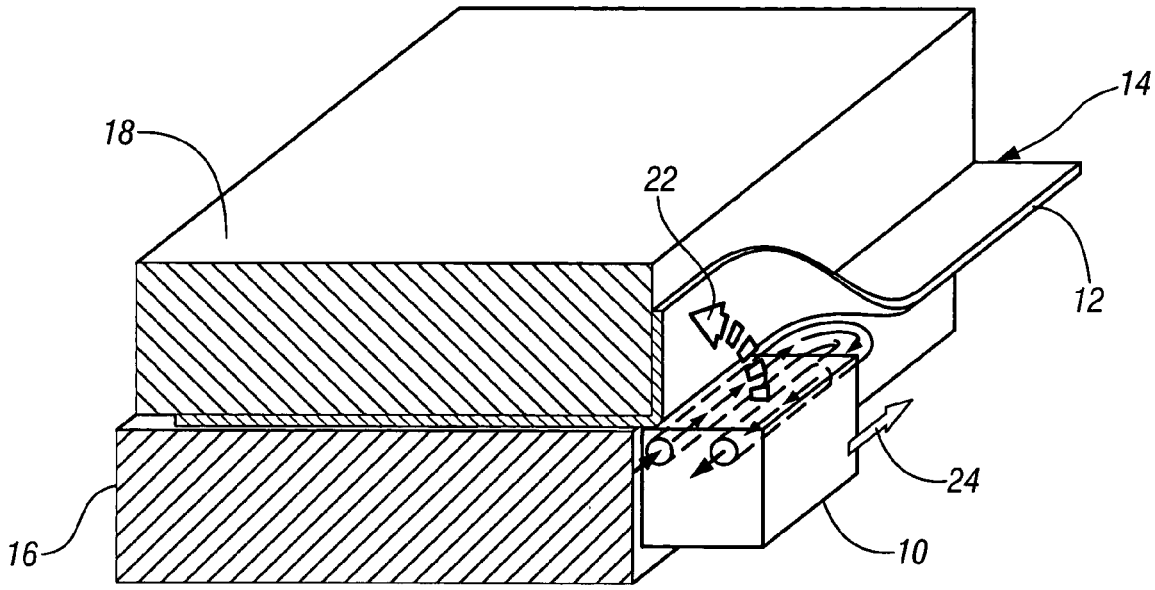
Figure 4:
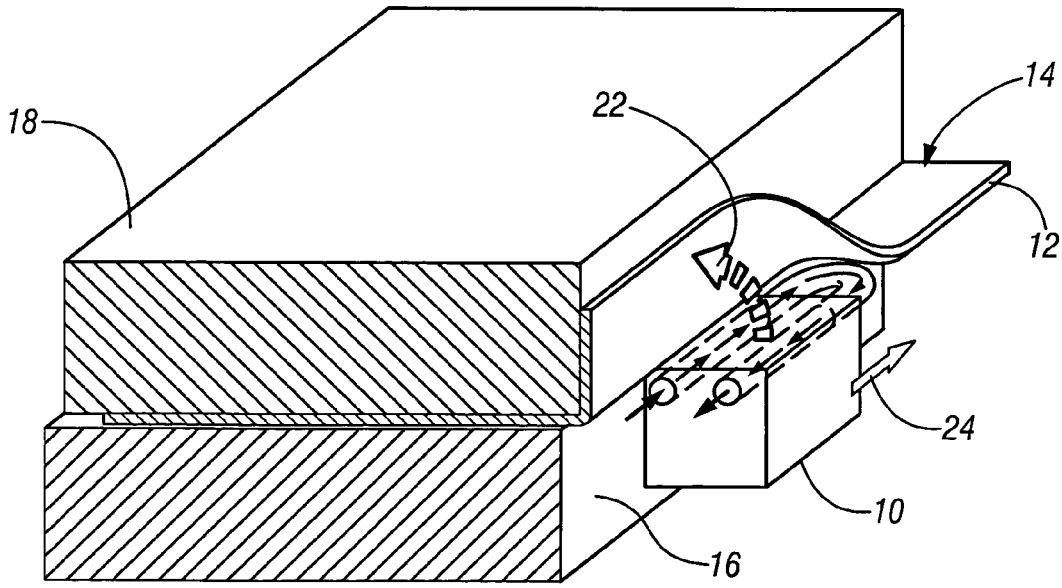
Figure 5:
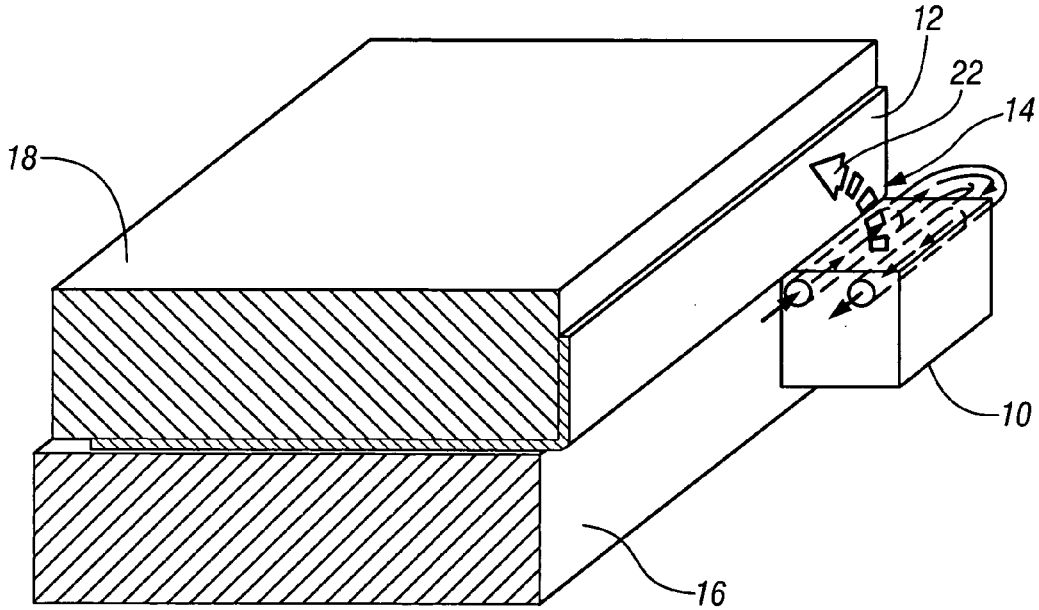

The magnetic field induces eddy currents 20 in the workpiece as shown in FIG. 2 and an associated secondary magnetic field. The magnetic fields of the coil and of the workpiece are opposite in sign so that an electromagnetic repulsive force 22 causes the deformation of the workpiece as shown in FIGS. 3-5. In this example, the electromagnetic force 22 bends the sheet metal flange to the 90° open position as shown in FIG. 5. The exact design, shape and electrical characteristics of the coil depend on the specific flange material and geometry.

Electromagnetic deformation takes place at very high strain rates, on the order of $10^3$ (in/in)/s, or greater. Metals, such as aluminum alloys, characterized by relatively poor formability in conventional forming processes, e.g. stamping, exhibit enhanced ductility when electromagnetically formed at very high rates. This "hyperplasticity" is usually accompanied by reduced springback and a decreased tendency for wrinkling.

As the flanging operation proceeds, the EMF coil is moved by the robot or other device in the direction of arrow 24 along the perimeter of the panel, as shown in FIGS. 3-4, to bend the flange to the 90° open position as shown in FIG. 5. As the coil moves along the panel, the 180° open flange 12 is progressively bent to the finished 90° open position of FIG. 5.

Finish Hemming

Referring now to FIGS. 6-9, there is shown a second apparatus and method for applying the EMF concept to the steps of flanging and hemming together of metal panels into a panel assembly. These figures illustrate a simplified apparatus and method for the hemming step.

Figure 6:
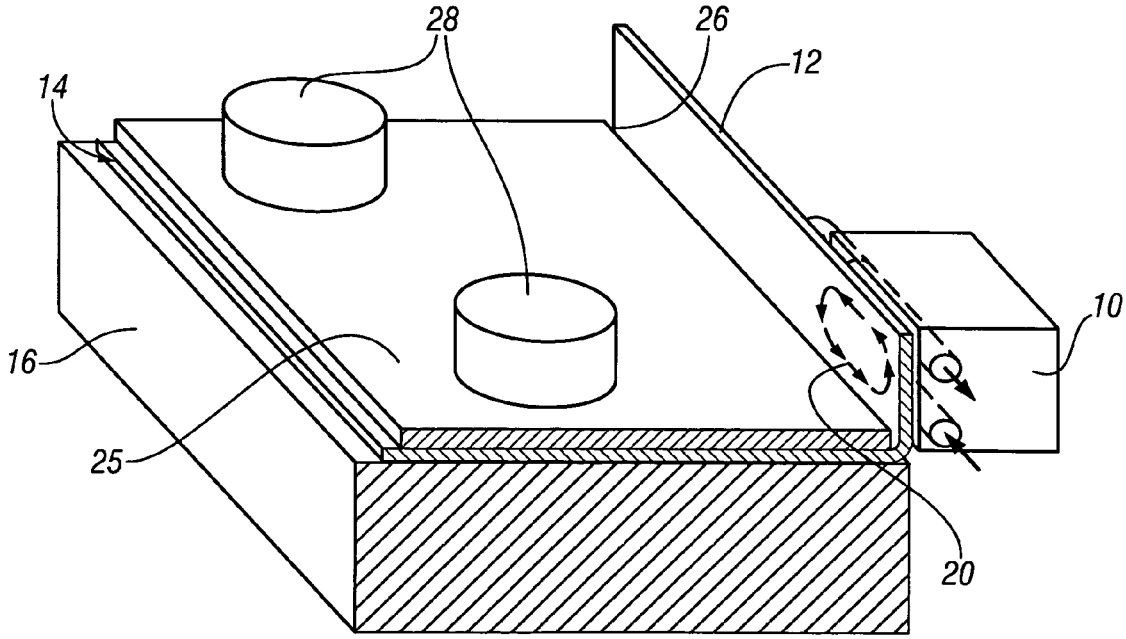
FIGS. 6-9 are simplified isometric cross-sectional views of an EMF hemming apparatus illustrating steps in the EMF hemming of a panel.

After a panel is flanged, either by EMF flanging or by conventional flanging methods, the EMF hemming method can be used to hem the panel assembly. FIG. 6 shows the apparatus including a support or anvil 16 supporting the outer panel 14 with its upstanding flange 12. An inner panel 25 is positioned against the main portion of the outer panel 14 with an outer edge 26 engaging the open flange 12. Hold-down tooling members 28 clamp the panels against the anvil 16 to hold the panels in assembly. An EMF coil 10, supported by a robot or other device, not shown, is positioned initially opposite one end of the flange 12

Figure 7:
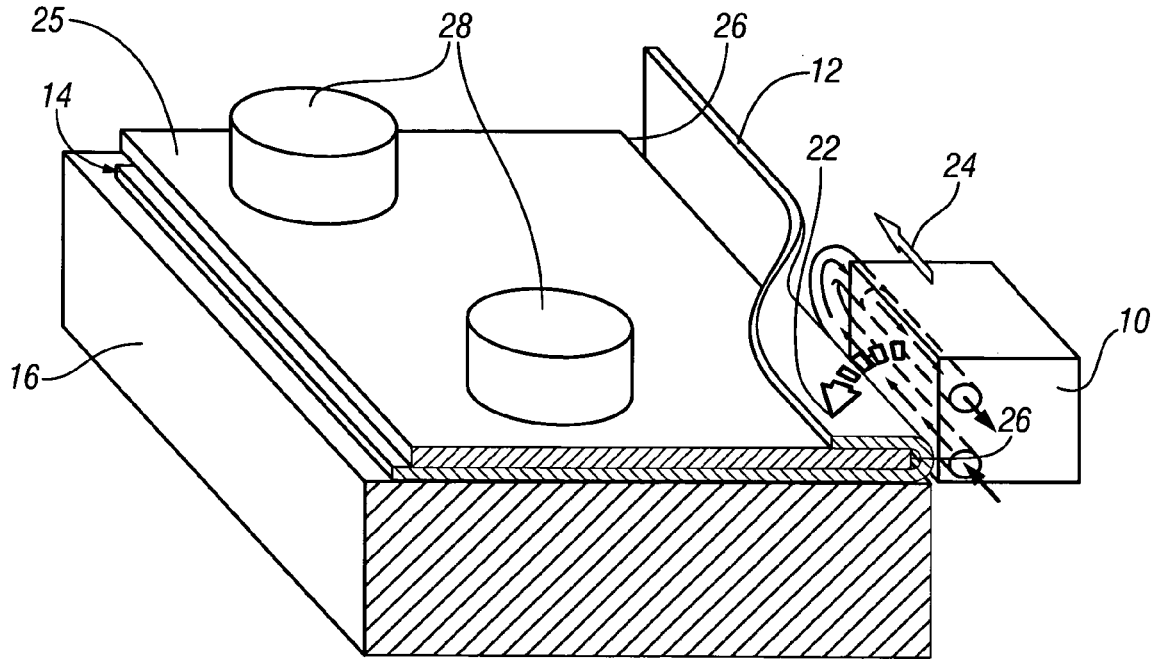
Figure 8:
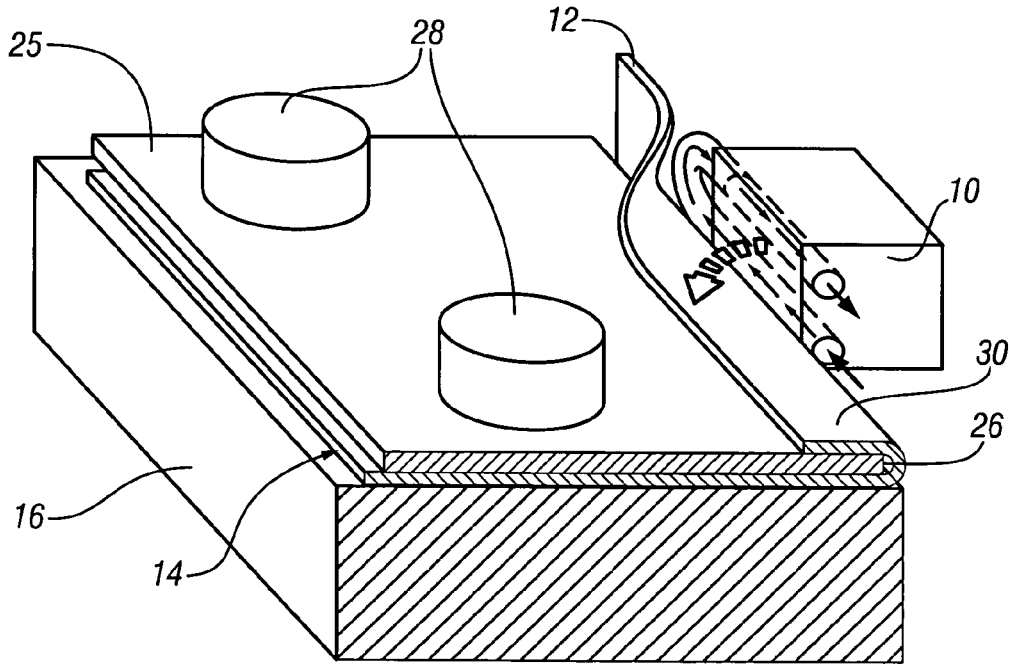
Figure 9:
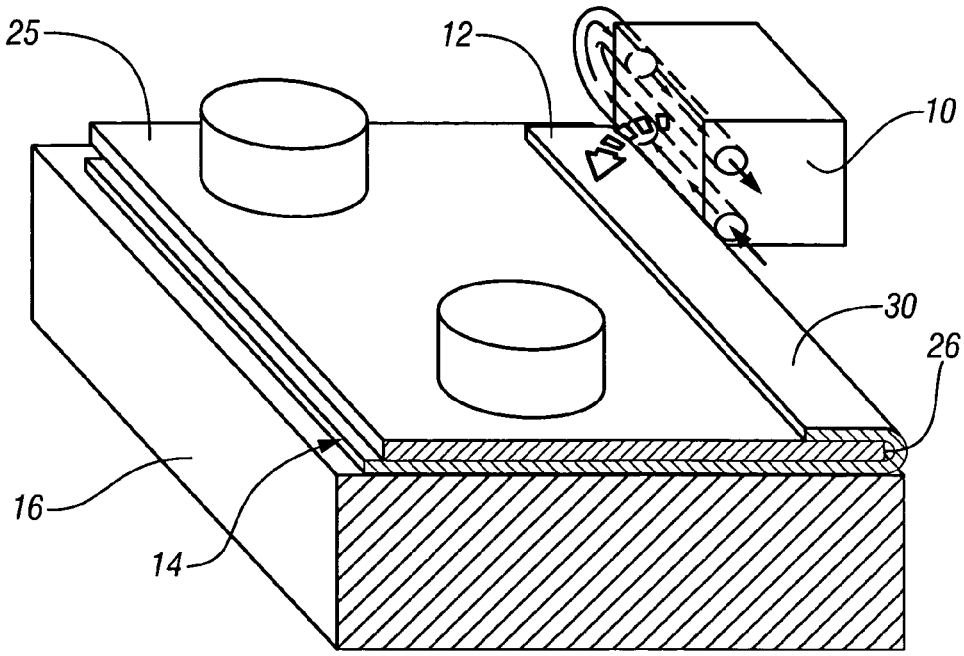

As described with respect to the flanging step, when current is pulsed through the EMF coil 10, eddy currents 20, shown in FIG. 6, result in electromagnetic forces 22 acting on the flange as shown in FIGS. 7-9. These forces act as the coil is traversed from one end of the flange to the other to bend the sheet metal in a non-plain strain manner.

As the hemming operation proceeds, the EMF coil 10 is moved in the direction of arrow 24 by the robot or other device along the perimeter or edge of the panel to bend the 90° open flange 12 to the flat hem position as shown in FIGS. 7 and 8. As the coil moves along, the 90° open flange 12 is progressively bent to a finished, flat hem 30. FIG. 9 shows the final position of the EMF coil as the hemming operation is finished.

In this embodiment, the EMF flanging and hemming procedures are distinct and can be applied together or independently to flange and/or hem sheet metal panel subassemblies. This EMF sheet bending procedure is "similar" to roller hemming concepts in the way that the sheet metal flange is progressively bent. By bending the flange in this way, the material deformed at the hemline goes through a "non-plane strain" bending path, avoiding plane strain bending (which is the worst case for extreme deformation—leading to failure by cracking in some aluminum alloys). The non-plane strain bending path provides more bending strain and enables flatter hemming with tighter radii in aluminum sheet metal panels without cracking along the hem line.

Alternative Embodiment

Figure 10:
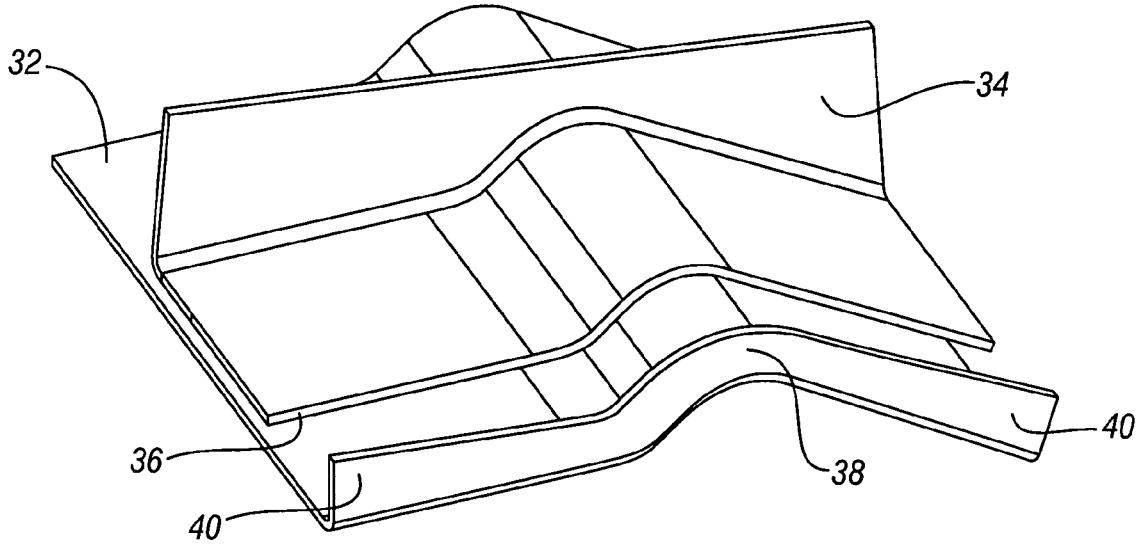
FIGS. 10-13 are simplified isometric cross-sectional views of the fixtures and workpieces for EMF hemming of a panel with complex curvature and illustrating steps in the EMF hemming method.

In another exemplary embodiment of the EMF hemming concept, an EMF coil could be incorporated within a traditional hemming device and specifically used to flatten hem areas or features that are very difficult to hem conventionally. One such difficult-to-hem area is shown schematically in FIG. 10.

In this embodiment, the outer panel 32 has complex curvature in the flange area to accommodate a design feature. The inner panel 34 is shown slightly away from the married position wherein the outer edge 36 of the inner panel would engage the inside of curved flange 38 as well as of adjacent straight flanges 40. The length (height) of the flange 38 in the difficult-to-hem area is usually cut much shorter than the flanges 40 immediately adjacent opposite ends of the difficult-to-hem area. The flange 38 length must be short in order to avoid splitting (of a stretch flange) or wrinkling (of a compression flange) during the conventional hemming procedure.

Whether a flange is a compression flange or a stretch flange depends on the complex curvatures of the outer panel 32 in the difficult-to-hem areas. When these areas have tight radii of curvature, the flanges must be very short (or narrow) and occasionally do not completely cover the edge 36 of the inner panel 34 after hemming. This situation does not provide a desirable appearance and may allow for water leakage if the hem adhesive does not provide a tight seal.

In accordance with the invention, a conventional hemming device (not shown) could be used for hemming the "simple" flange areas 40, while an EMF coil, not shown, would be used to hem the difficult-to-hem flange 38. The EMF coil could be mounted on the conventional hemmer and driven by a slide or other mechanism (not shown) to move into close proximity to the flange 38 for hemming.

Figure 11:
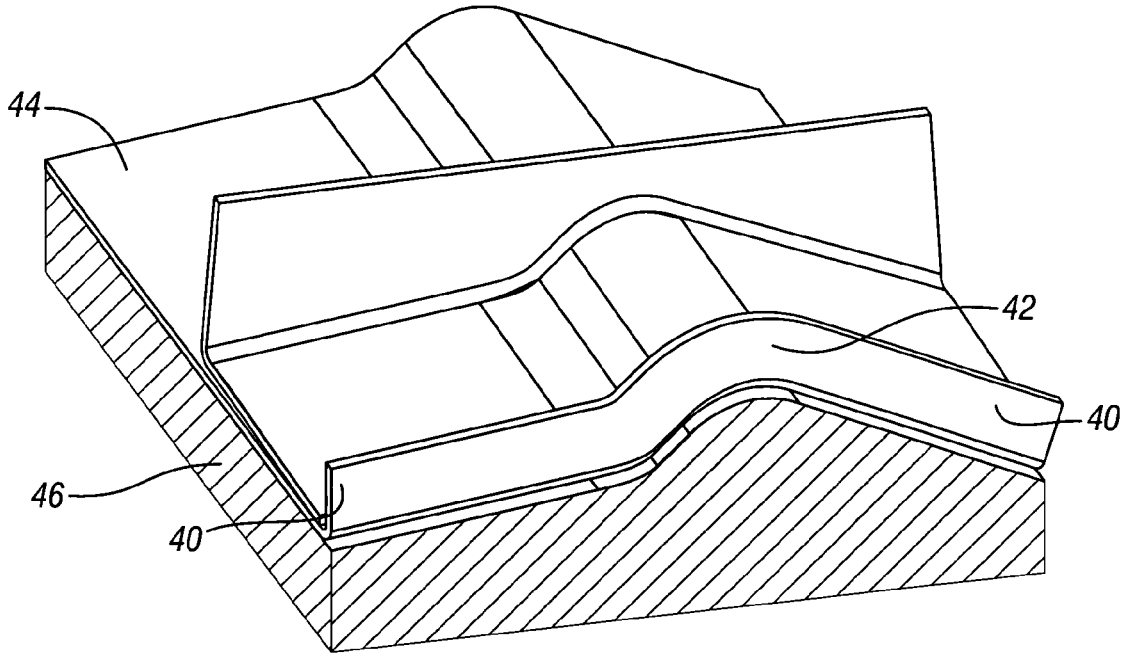

Because EMF makes use of "hyperplasticity" to deform the sheet metal, it can be used to successfully hem flanges that would be considered too long (or wide) for conventional hemming. The hyperplastic deformation can resist splitting of stretch flanges and can inhibit wrinkling of compression flanges. As a result, the flange length in difficult-to-hem areas can be made longer, as shown by the curved flange 42 of FIG. 11, in order to assure adequate sealing of the hem.

During hemming, the outer panel 44 is supported by an anvil 46 and the inner panel 34 is in the married position for hemming and has the longer curved flange 42.

Figure 12:
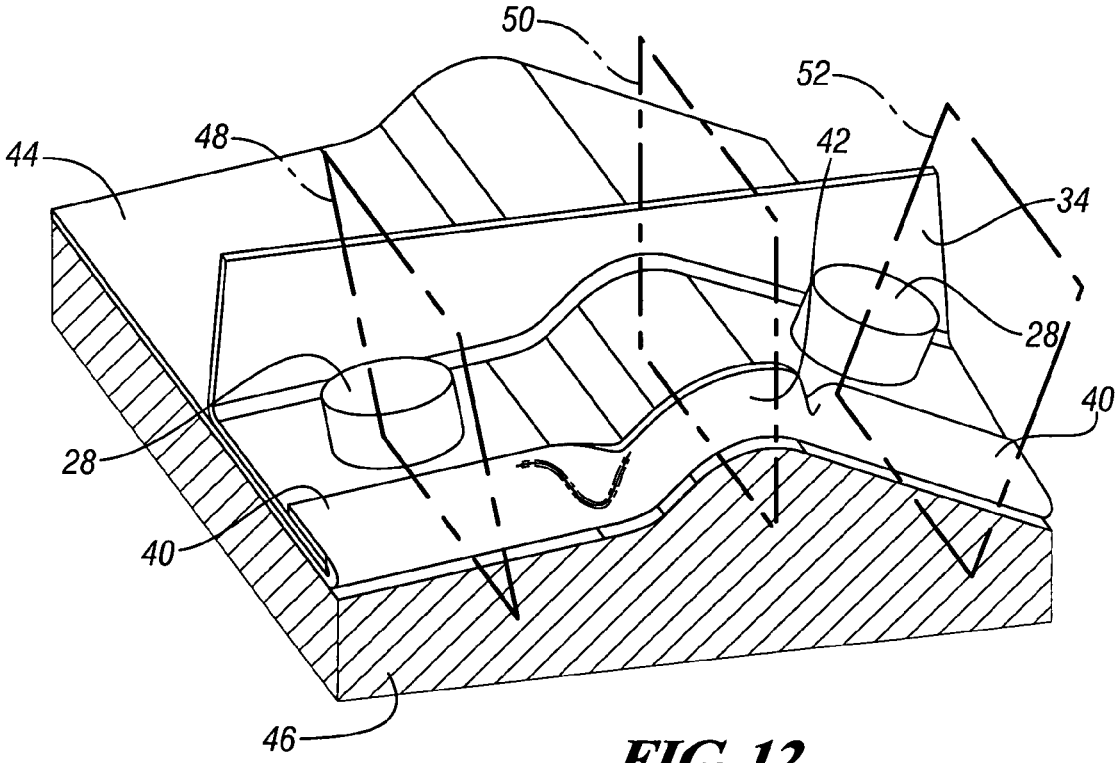
Figure 12A:
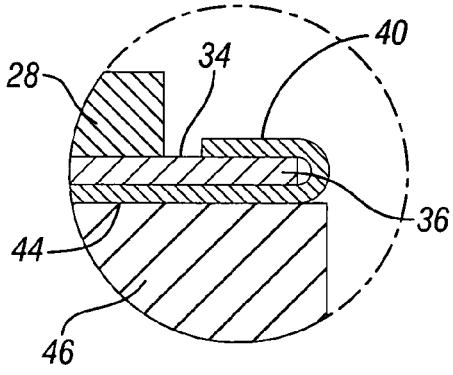
Figure 12B:
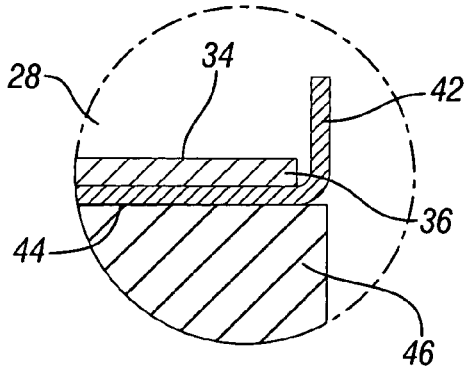
Figure 12C:
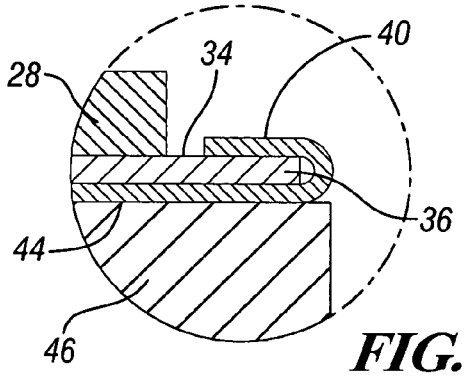

FIG. 12 illustrates one possible hemming sequence for this application with the hold down fixtures represented by numeral 28. In this case, a conventional hemmer, not shown, could hem the "simple" flanges 40, leaving the difficult-to-hem flange section 42 in the open position as shown by the cross-sectional views 12A, 12B, 12C taken in planes 48, 50, 52 of each flange area. FIGS. 12A and 12C show their flanges 40 folded over to the finished flat hem position, while FIG. 12B shows the central difficult-to-hem flange 42 still in the 90° open position.

Figure 13:
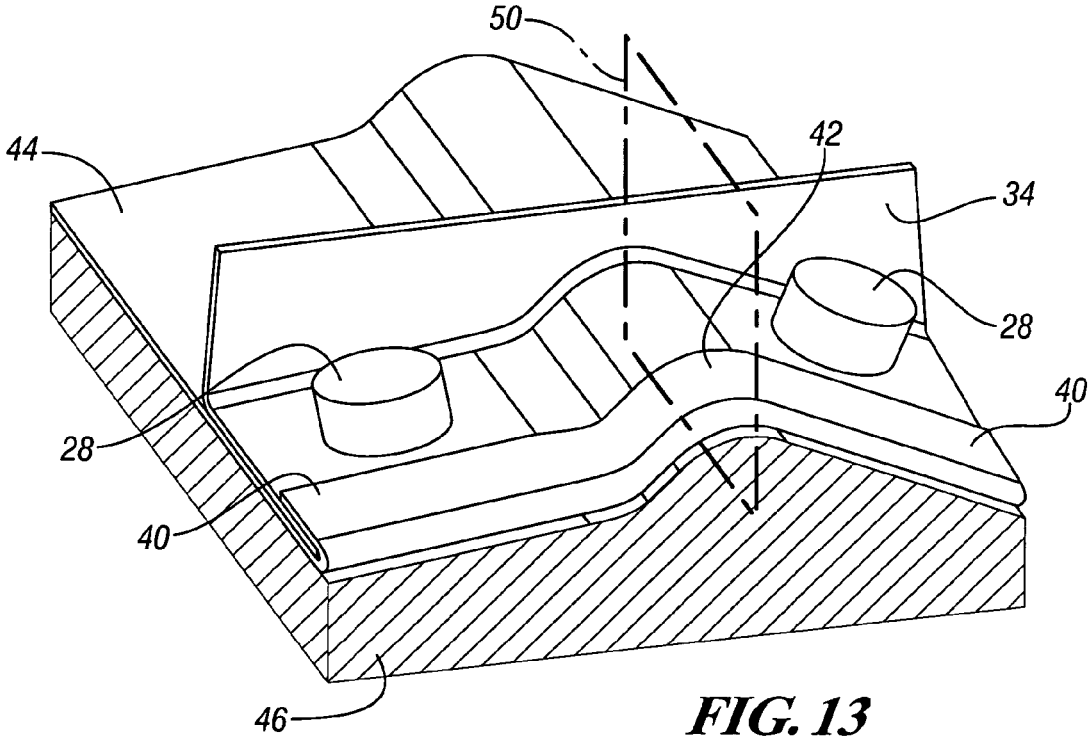
Figure 13A:
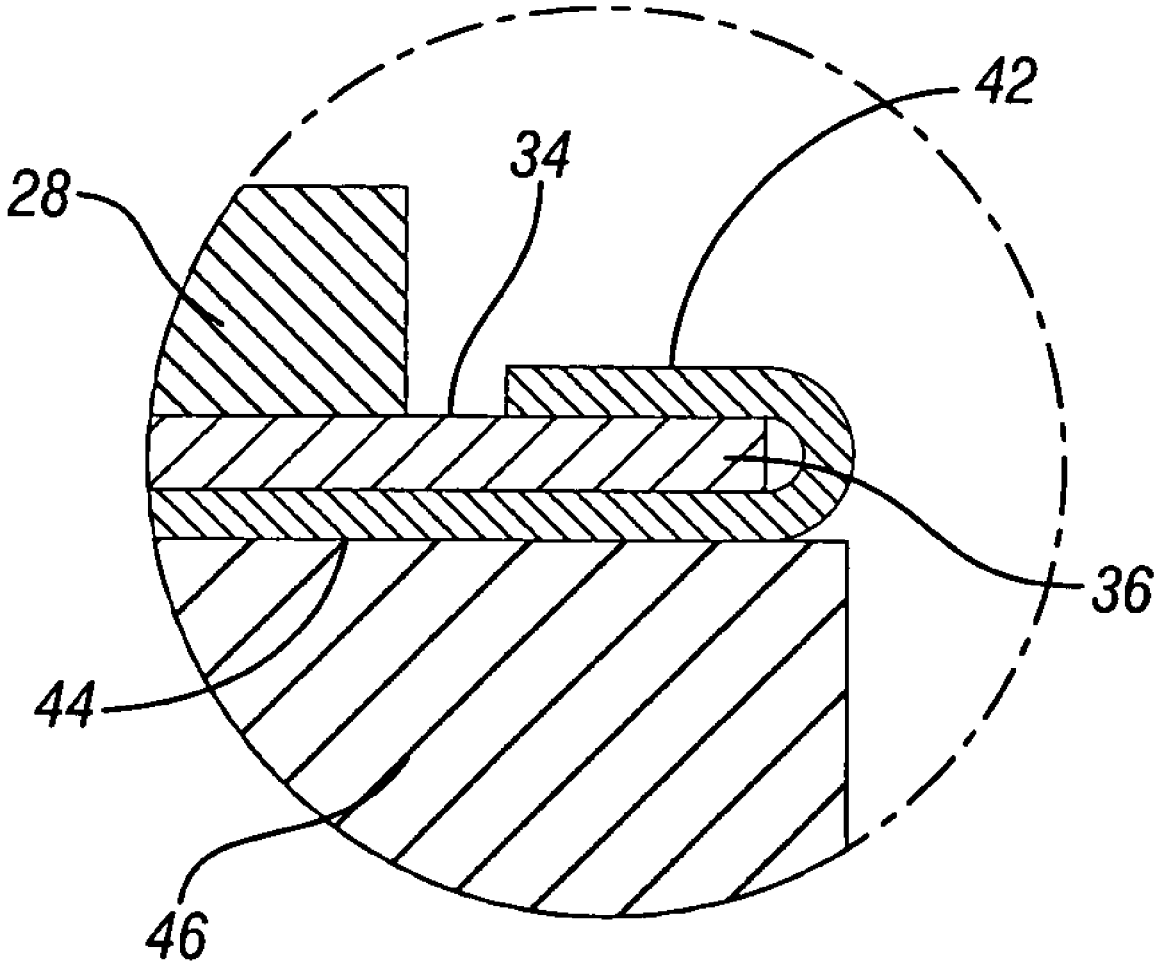

Finally, the EMF coil, not shown, would be moved into position to flat hem the difficult-to-hem flange 42, with the longer flange length, without wrinkling or splitting as shown in FIG. 13 and cross section 13A. The operation of the EMF coil, not shown in this embodiment, may be like that of coil 10 previously described. The coil may be designed to travel along the length of the flange where non-plane strain bending of the flange is desired or necessary, or the coil could be configured to the shape of the flange section 42, to bend this section in a single fold.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A method of applying electromagnetic force (EMF) for hemming together edges of at least two metal panels to form an edge hemmed panel assembly, the method comprising:

holding at least first and second metal panels with faces aligned in mated face engagement, the first panel having a flange bent at an angle generally perpendicular to the mated face of the first panel across and beyond an edge face of the second panel;

positioning an EMF hemming coil closely opposite an outer face of the bent flange; and energizing the coil to generate eddy currents in the flange that form opposing magnetic fields between the coil and the flange and apply a force that bends the flange against and generally parallel to the mated face of the second panel to form a finished hem of the first panel around the edge face of the second panel.

2. A method as in claim 1 wherein the flange has at least one straight portion and at least one difficult to flange shaped portion, the method including using conventional mechanical hemming for hemming the straight portions and hemming the shaped portions by EMF hemming.

3. A method as in claim 2 including hemming each shaped portion by traversing the EMF coil in a single pass along each shaped portion of the flange.

4. A method of applying electromagnetic force (EMF) for hemming together edges of at least two metal panels to form an edge hemmed panel assembly, the method comprising:

holding at least first and second metal panels with faces aligned in mated face engagement, the first panel having a flange bent at an angle generally perpendicular to the mated face of the first panel across and beyond an edge face of the second panel;

positioning an EMF hemming coil closely opposite an outer face of the bent flange; and energizing the coil to generate eddy currents in the flange that form opposing magnetic fields between the coil and the flange and apply a force that bends the flange against and generally parallel to the mated face of the second panel to form a finished hem of the first panel around the edge face of the second panel initially positioning the EMF coil at one end of the flange and traversing the coil to an opposite end of the flange during forming of the hem so that the flange is subjected to non-plane strain bending by which formability of the flange is increased.

5. A method as in claim 4 including holding the first panel in a flanging fixture, prior to the first holding step, and bending the flange to said angle with an EMF flanging coil by energizing and traversing the coil along the length of the flange to form the flange by non-plane strain bending.

6. A method as in claim 5 including forming the flange with a single pass of the flanging coil along the flange.

7. A method as in claim 4 including forming the hem in a single pass of the hemming coil.

* * * * *